US010559295B1

(12) United States Patent
Abel

(10) Patent No.: US 10,559,295 B1
(45) Date of Patent: Feb. 11, 2020

(54) ARTIFICIAL REVERBERATOR ROOM SIZE CONTROL

(71) Applicant: Jonathan S. Abel, Menlo Park, CA (US)

(72) Inventor: Jonathan S. Abel, Menlo Park, CA (US)

( * ) Notice: Subject to any disclaimer, the term of this patent is extended or adjusted under 35 U.S.C. 154(b) by 0 days.

(21) Appl. No.: 16/213,993

(22) Filed: Dec. 7, 2018

Related U.S. Application Data

(60) Provisional application No. 62/596,656, filed on Dec. 8, 2017.

(51) Int. Cl.
*G10K 15/10* (2006.01)
*H04S 7/00* (2006.01)

(52) U.S. Cl.
CPC ..... *G10K 15/10* (2013.01); *H04S 7/305* (2013.01); *H04S 2420/01* (2013.01)

(58) Field of Classification Search
CPC ..... G10K 15/10; H04S 7/305; H04S 2420/01
See application file for complete search history.

(56) References Cited

U.S. PATENT DOCUMENTS

| | | | | |
|---|---|---|---|---|
| 2,230,836 | A | 2/1941 | Hammond | |
| 4,099,027 | A | 7/1978 | Whitten | |
| 5,491,754 | A | 2/1996 | Jot et al. | |
| 5,502,747 | A | 3/1996 | McGrath | |
| 5,748,513 | A | 5/1998 | Van Duyne | |
| 6,284,965 | B1 | 9/2001 | Smith et al. | |
| 9,805,704 | B1 * | 10/2017 | Abel | G10H 5/02 |
| 2008/0232603 | A1 * | 9/2008 | Soulodre | G01H 7/00 381/63 |
| 2009/0052682 | A1 | 2/2009 | Kuroiwa | |
| 2010/0144306 | A1 | 6/2010 | Karr | |
| 2011/0064235 | A1 | 3/2011 | Allston | |
| 2011/0305347 | A1 | 12/2011 | Wurm | |
| 2012/0011990 | A1 | 1/2012 | Mann | |
| 2013/0202125 | A1 | 8/2013 | De Sena et al. | |
| 2016/0275956 | A1 * | 9/2016 | Lee | H04S 3/00 |

OTHER PUBLICATIONS

Abel et al., "Luciverb: Iterated Convolution for the Impatient," Audio Engineering Society Convention 133, Oct. 2012, pp. 1-10.
Della Pietra et al., "On the Dynamic Behavior of Axially Excited Helical Springs," MECCANICA, vol. 17, pp. 31-43, 1982.
Fletcher et al., "The Physics of Musical Instruments," 2nd ed., Springer, 2010, pp. 128-130.
Garcia, "Optimal Files Partition for Efficient Convolution with Short Input/output Delay," Audio Engineering Society Convention 113, Oct. 2002, pp. 1-9.
Gardner, "Efficient Convolution without Input-Output Delay," J. Audio Eng. Soc., vol. 43, No. 3, pp. 127-136, 1995.
(Continued)

*Primary Examiner* — Regina N Holder
(74) *Attorney, Agent, or Firm* — Foley & Lardner LLP

(57) ABSTRACT

In music recording and virtual reality applications, it is desired to control the perceived size of a synthesized acoustic space. In an embodiment, a room size parameter is used to modify characteristics of an artificial reverberator so as to affect a listener's sense of the size of the acoustic space. Properties of the reverberation related to perceived room size such as decay time and equalization are adjusted interactively.

14 Claims, 14 Drawing Sheets

(56) References Cited

OTHER PUBLICATIONS

Jot, "Digital Delay Networks for Designing Artificial Reverberators," in Audio Engineering Society Convention 90, Feb. 1991, pp. 1-17.
Karjalainen et al., "More about this reverberation science: Perceptually good late reverberation." Audio Engineering Society (2001).
Lee et al., "A Reverberator with Two-Stage Decay and Onset Time Controls," Audio Engineering Society Convention 129, preprint No. 8208, Nov. 2010, pp. 1-6.
Makivirta et al., "Low-Frequency Modal Equalization of Loudspeaker-Room Responses," AES 111, Sep. 2001.
Matthews et al., "Methods for Synthesizing Very High {Q} Parametrically Well Behaved Two Pole Filters," Proc. Swedish Musical Acoustics Conference, Aug. 2003, pp. 1-4.
Meinema et al., "A New Reverberation Device for High Fidelity Systems," J. Audio Eng. Soc., vol. 9, No. 4, pp. 284-289, 324-326, 1961.
Morse et al., "Theoretical Acoustics", Princeton University Press, 1987, pp. 467-607.
Schroeder, "Natural Sounding Artificial Reverberation," Audio Engineering society Convention 13, Oct. 1961, pp. 1-18.
Vallmaki et a., "Fifty Years of Artificial Reverberation," IEEE Transactions on Audio, Speech, and Language Processing, vol. 20, No. 5, pp. 1421-1448, Jul. 2012.

* cited by examiner

ARTIFICIAL REVERBERATOR ROOM SIZE CONTROL

CROSS-REFERENCE TO RELATED APPLICATIONS

The present application claims priority to U.S. Provisional Patent Application No. 62/596,656 filed Dec. 8, 2017, the contents of which are incorporated herein by reference in their entirety.

TECHNICAL FIELD

The present embodiments relate generally to audio signal processing, and more particularly to artificial reverberation.

BACKGROUND

The following description is provided to assist the understanding of the reader. None of the information provided or references cited is admitted to be prior art.

Computational methods for simulating reverberant environments are well developed [2], and find application fields ranging from virtual reality to music recording and film audio production. Room acoustics is an approximately linear and time-invariant process, and one widely used method for room acoustics simulation is convolution with a measured or synthesized room impulse response [3, 4]; see FIG. 1. Another commonly used approach is to delay the input by different, incommensurate amounts, and filter, mix, and feedback the delayed signals in a process akin to the generation of an increasingly dense set of reflections that develop in a room. The feedback delay network (FDN), shown in FIG. 2 is an example of this approach, and provides separate mechanisms to control the decay time as a function of frequency and the rate of echo density increase [5]. A third approach decomposes the room response into a parallel set of mode responses, as shown in FIG. 3, with each mode response corresponding to a resonance of the room and characterized by an amplitude, resonant frequency, and decay time [6, 7].

In a number of scenarios, it is desired to manipulate or control the perceived size of a given acoustic space. In a virtual reality or film audio setting, for instance, the size of the room might be changing over time, and it is desired that the acoustics of the space change accordingly. In a music recording, performance, or composition environment, different sizes of acoustic space convey different musical impressions, and it is desired to have a palette of room size options associated with a given room response for artistic purposes.

Larger spaces tend to be more reverberant and "darker" than smaller ones, but there doesn't seem to be available a systematic way to manipulate the perceived size associated with a given room response. Additionally, changes in controls driving common reverberators often produce zippering and other unwanted artifacts in the output while the controls are slewed. Finally, changes over time in the size of an actual room can produce Doppler shifts that, while appropriate for virtual reality applications, are undesired in musical applications in which pitches can be detuned.

Thus, there is a need for an artificial reverberator that provides control over the perceived size of the simulated space. There is also a need for the perceived room size to vary smoothly over time in response to a smoothly changing room size control. In addition, there is a need for a room size control that doesn't produce Doppler shifts in response to a continuously changing room size.

SUMMARY

One or more embodiments provide an artificial reverberator with a control that adjusts perceived room size. These and other embodiments provide a control capable of smoothly changing perceived room size, and to do so with or without the Doppler shifts that would naturally occur in a physical room of changing size. In accordance with certain aspects, the room impulse response is stretched in time, and its decay rate as a function of frequency modified to properly account for the changing relative importance of air absorption and materials absorption.

In one embodiment, the room impulse response is resampled in time according to a room size control, and its decay rate in at least one frequency band is modified. In another embodiment, a high-frequency reverberant room response is synthesized to extend the reverberation to frequencies which are warped into the audio band.

In another embodiment, time delays in a delay network reverberator are stretched according to a room size control, and the feedback filters are warped and scaled according to the new decay times and delay lengths.

In yet another embodiment, a modal reverberator is modified according to a room size control, with the mode frequencies and dampings being adjusted. An additional embodiment further synthesizes high-frequency modes which may affect the audio band for sufficiently large rooms.

In further embodiments, some of the delays, decay times, and modes are unaffected or only modestly affected by the room size control so as to model an aspect of the space increasing in size, e.g., only a pair of walls becoming further apart. Additional embodiments include continuous parameter changes versus cross-faded parallel system outputs to include or suppress Doppler shifts with changing room size.

BRIEF DESCRIPTION OF THE DRAWINGS

These and other aspects and features of the present embodiments will become apparent to those ordinarily skilled in the art upon review of the following description of specific embodiments in conjunction with the accompanying figures, wherein.

DETAILED DESCRIPTION

The present embodiments will now be described in detail with reference to the drawings, which are provided as illustrative examples of the embodiments so as to enable those skilled in the art to practice the embodiments and alternatives apparent to those skilled in the art. Notably, the figures and examples below are not meant to limit the scope of the present embodiments to a single embodiment, but other embodiments are possible by way of interchange of some or all of the described or illustrated elements. Moreover, where certain elements of the present embodiments can be partially or fully implemented using known components, only those portions of such known components that are necessary for an understanding of the present embodiments will be described, and detailed descriptions of other portions of such known components will be omitted so as not to obscure the present embodiments. Embodiments described as being implemented in software should not be limited thereto, but can include embodiments implemented in hardware, or combinations of software and hardware, and vice-versa, as will be apparent to those skilled in the art, unless otherwise specified herein. In the present specification, an embodiment showing a singular component should not be considered limiting; rather, the present disclosure is intended to encompass other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present embodiments encompass present and future known equivalents to the known components referred to herein by way of illustration.

According to certain aspects, the present embodiments relate to an artificial reverberator that provides control over the perceived size of the simulated space. It can also provide for the perceived room size to vary smoothly over time in response to a smoothly changing room size control. Additionally or alternatively, it provides a room size control that doesn't produce Doppler shifts in response to a continuously changing room size.

Figure 4:
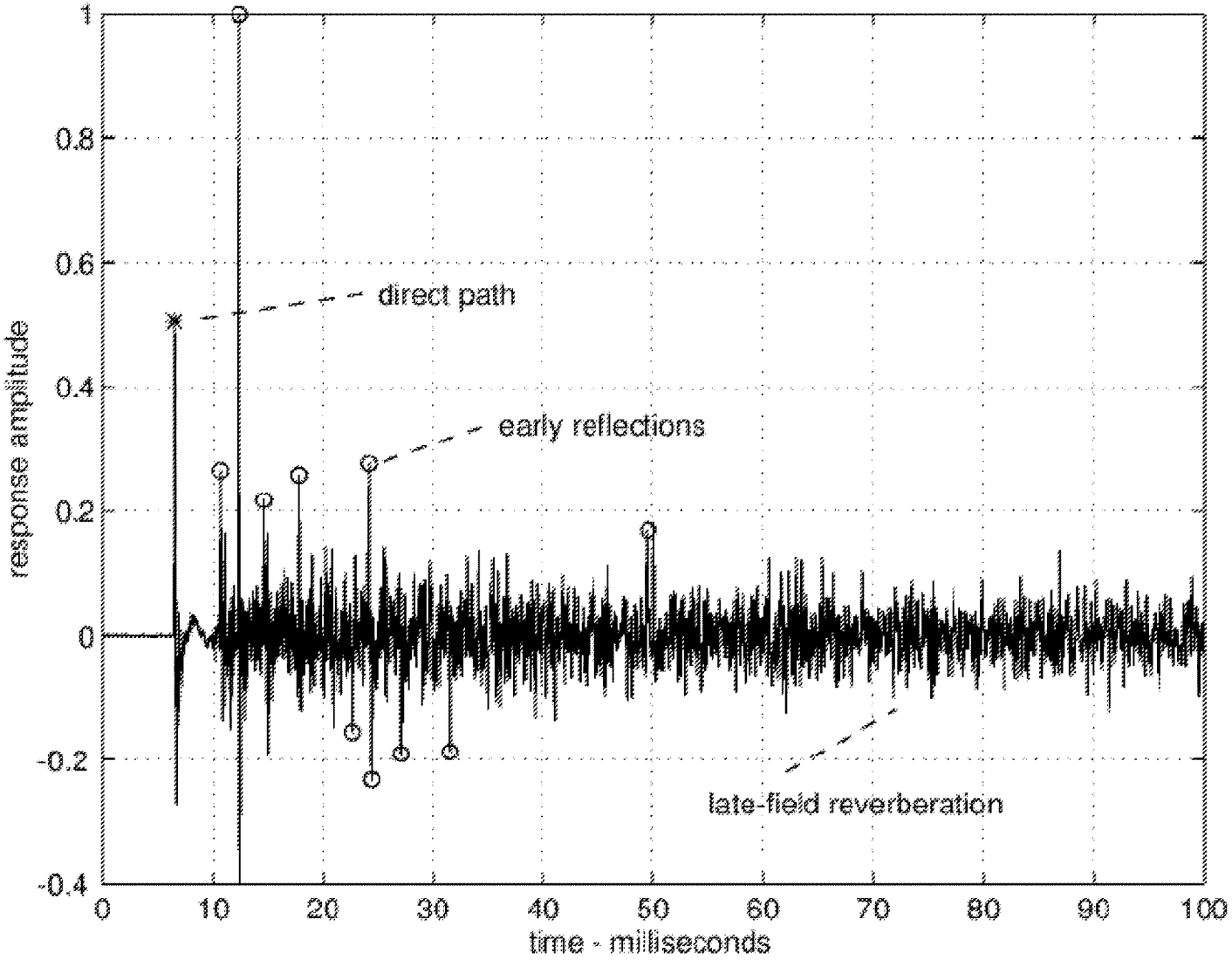
FIG. 4 is a waveform diagram illustrating an example room impulse response showing the direct path, early reflections, and late-field reverberation.

Among other things, the present Applicant recognizes that the room response to a transient sound is often described as a sequence of events over time, a direct path followed by early reflections that give way to late-field reverberation, as seen in FIG. 4. The direct path carries with it information about the source direction, and arrives with a time delay and amplitude fixed according to the source-listener distance. The early reflections contain information about the geometry of the space, and can be simulated using details of the architecture of the space [13]. The late-field reverberation brings to the listener information about the volume of the space and materials present in the space through the rates of sound energy decay as a function of frequency. Roughly speaking, the reverberation time is proportional to the ratio of the room volume to the room absorbing surface area [14].

If the room size were, for example, doubled, with everything else remaining the same, then the timing of the direct path and early reflections would be stretched by a factor of two. Similarly, if the room size were doubled, then its volume would increase by a factor of eight, while its absorbing area would increase by a factor of four, thereby doubling the reverberation time.

Reasoning along these lines was used by Spandcock [8] in building scale models of pro-posed concert halls to test how they might sound when built. Spandcock argued that a scale model of a concert hall made with the appropriate materials and filled with a dried gas would respond to a given high-frequency sound the way the larger actual space would respond to a low-frequency sound having the same relative wavelength. Spandcock describes using a magnetic tape deck to play back a sound into the scale model at, say, eight-times speed, while simultaneously recording the response in the model. The recording was then played back, slowed by the same factor. In this way, the original pitch was restored, and the reverberation time increased to match that of the hypothesized full-scale hall.

As described in [1], this approach was independently discovered by Walter Murch while working as a sound editor for motion pictures in the late 1960s, and was used to make long-lasting reverberation. Spratt, et al. in [1] present a digital technique for implementing a real-time version of the method, using a loudspeaker and microphone in a physical room. The technique is described as being mathematically equivalent to stretching the room impulse response in time, which has the effect of increasing the reverberation time, and stretching the reflection arrival times.

Spratt, et al. argue that the method similar to slowing the speed of sound or increasing the room size. However, doing either of these will not result in proper reverberation time as a function of frequency, as the relative absorption of sound by air and room materials will not be taken into account.

The present embodiments may be implemented using any number of artificial reverberation methods. One idea is to warp the time and frequency axes, and adjust the decay times of a given reverberation impulse response according to a desired room size. In addition, the source loudness and radiation pattern may be adjusted according to the room size. Different architectures will be clear to those skilled in the art given the examples described below.

Reverberation Time

First, the change in reverberation time in response to a changing room size as a result of different relative contributions of materials absorption and air absorption is described.

As described in [14] and elsewhere, the decay over time of well mixed acoustic energy in a room can be approximated by examining a room with volume V and having objects and surfaces with absorbing area A. The energy density w(t) as a function of time t is assumed to be well mixed, and independent of position within the room. After a period of time Δt, the total energy in the room, the product of the energy density and the volume, Vw(t+Δt), will be that at time t less what is lost due to interactions with absorbing surfaces and objects and air propagation, $$Vw(t+\Delta t)=Vw(t)-Acgw(t)\Delta t-V\alpha w(t)\Delta t, \tag{1}$$

where the term AcgΔt w(t) represents surface interaction absorption, and is proportional to the time interval Δt, sound speed c, a constant g, absorbing area A, and energy density w(t), and the term Vαw(t) represents air absorption, and is proportional to the volume V, an absorption coefficient α, time interval Δt, and energy density w(t). These absorption terms are intuitively sensible—the greater the time interval, the more energy that can be absorbed; the greater the energy density, the more energy that can "leave" the space during the time interval. Rearranging terms, and taking Δt→0, gives $$\frac{w(t+\Delta t)-w(t)}{\Delta t} \rightarrow \frac{w}{t} = -\frac{1}{\tau}w(t), \tag{2}$$

$$w(t) = w_0\exp\{-t/\tau\},\ t \geq 0, \tag{3}$$

with $w_0$ being the energy density at time t=0, and τ being a time constant increasing with increasing volume, and decreasing with increasing absorbing area, $$\tau = \frac{V}{Acg + V\alpha}. \tag{4}$$

In other words, the energy density in a well mixed room with decay exponentially, decreasing by a factor of 1/e every τ units of time. It is typical to measure reverberation time in terms of the time taken for energy to decrease 60 dB, $T_{60}$, in which case it follows:

$$T_{60} = \frac{\log_{10}1000}{\log_{10}e}\tau, \tag{5}$$

for example, measured in units of seconds per 60 dB decay.

Note that the energy density is also a function of frequency ω, w(t, ω), which was dropped from the discussion here for simplicity of presentation. It carries over to frequency-dependent materials and air absorption simply by making the absorbing area A and air absorption a frequency-dependent.

Consider a room described by a nominal length $L_0$. Now scale the room and all of its surfaces and objects to have a new characteristic length L. It is desired to understand how the decay time changes with a changing room size L. Assuming that the room volume V is proportional to $L^3$, and the absorbing area A proportional to $L^2$, the decay time of the resized room $T_{60}(L)$ is then $$T_{60}(L) = \frac{L}{L_0\mu + L\alpha}, \tag{6}$$

where μ has been introduced to represent the materials absorption for the nominally sized room, and air absorption a and materials absorption μ have been expressed in terms of, for example, 60 dB decay per unit time.

Note that the decay time at the nominal room size, $$T_0=T_{60}(L_0), \tag{7}$$

may be estimated from the room impulse response or otherwise modeled, and that the air absorption a is known, for instance derived assuming a given temperature, pressure, and humidity, or tabulated [15, 16]. Accordingly, setting $L=L_0$ and solving (6) for the unknown materials absorption μ gives $$\mu = \frac{1}{T_{60}(L_0)} - \alpha. \tag{8}$$

Note that it might be that case that due to estimation errors, the reverberation time, $T_{60}(L_0)$, might exceed the air absorption-only reverberation time 1/α, and (8) would produce a negative value for μ. In these cases (or at such frequencies that this is true), a value of μ=0 is preferably used, and the reverberation time will not be affected by room size. If it is desired to have a changing reverberation time with room size, a small value for μ could be selected.

Substituting for μ in (6) gives $T_{60}(L)$, the decay time as a function of room size L. In the case that μ is given by (8) and not modified, a little algebra gives an expression for $T_{60}(L)$ in terms of the nominal decay time $T_0$ and the decay time if the only absorption of sound energy were due to air $T_{air}$, $$T_{60}(L) = \frac{L\cdot T_0 T_{air}}{L_0\cdot T_{air} + (L-L_0)\cdot T_0}. \tag{9}$$

Figure 5:
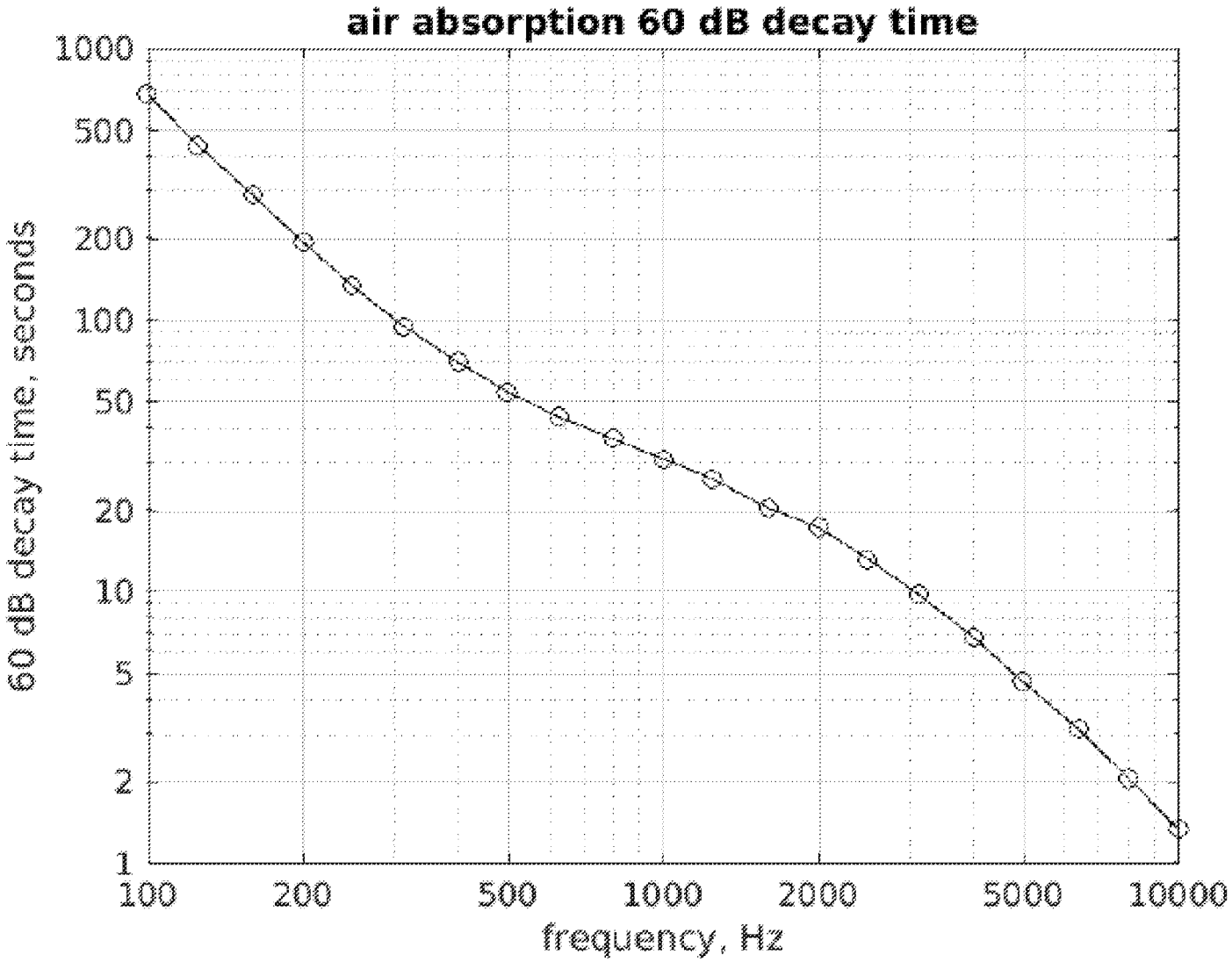
FIG. 5 is a waveform diagram illustrating an example reverberation time of a room with perfectly reflecting walls filled with STP air at 50% humidity.
Figure 6:
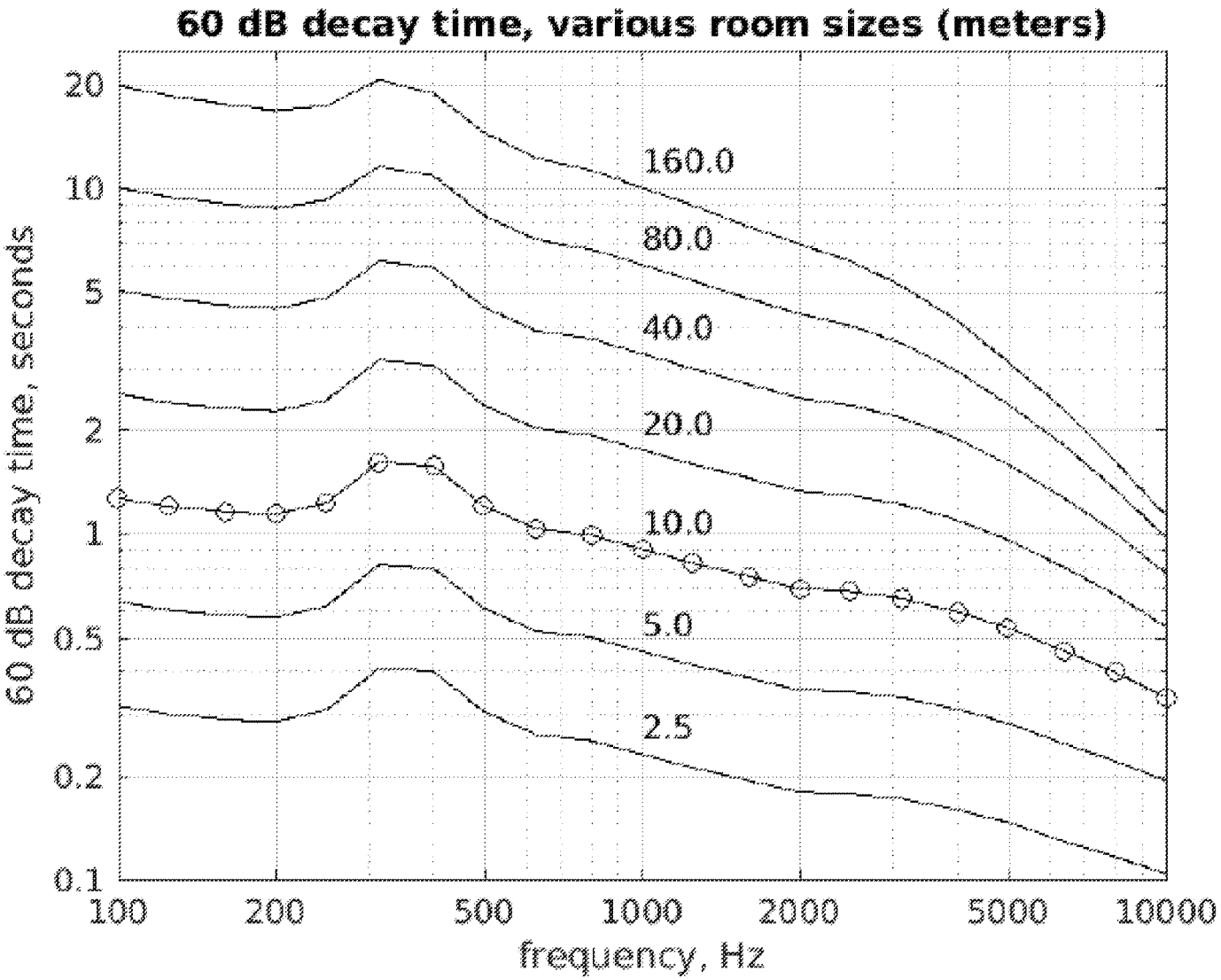
FIG. 6 is a waveform diagram illustrating an example reverberation time as a function of room size according to embodiments.

As an example of a changing reverberation time as a function of room size, consider the reverberation time of a church with a 10-meter nominal size, shown as a line with markers in FIG. 6. Also shown are the reverberation times of hypothesized churches that are 2, 4, 8, and 16 times as large, and 2, and 4 times as small. For reference, the reverberation time associated with air absorption only, a for 50% humidity and 25° C. is shown in FIG. 5. Generally speaking, a doubling of the room size doubles the reverberation time. However, for large rooms and high frequencies (where the air absorption and materials absorption are somewhat comparable), a doubling of the room size increases the reverberation time by a good bit less than the factor of two seen at low frequencies or for small rooms. Note that this is the case for high frequencies in FIG. 6.

In an embodiment, the effect of a finite air absorption may be exaggerated or suppressed by reducing or increasing, or even replacing the air absorption characteristic shown in FIG. 5. An aspect is to have different frequency bands express different reverberation time scaling with room size. Note that in doing so, when solving (8) for the materials absorption μ(ω), any frequencies ω producing values less than zero should be preferably be set to zero. That is, $$\mu(\omega) = \max\left(0, \frac{1}{T_{60}(L_0, \omega)} - \alpha(\omega)\right). \quad (10)$$

Figure 7:
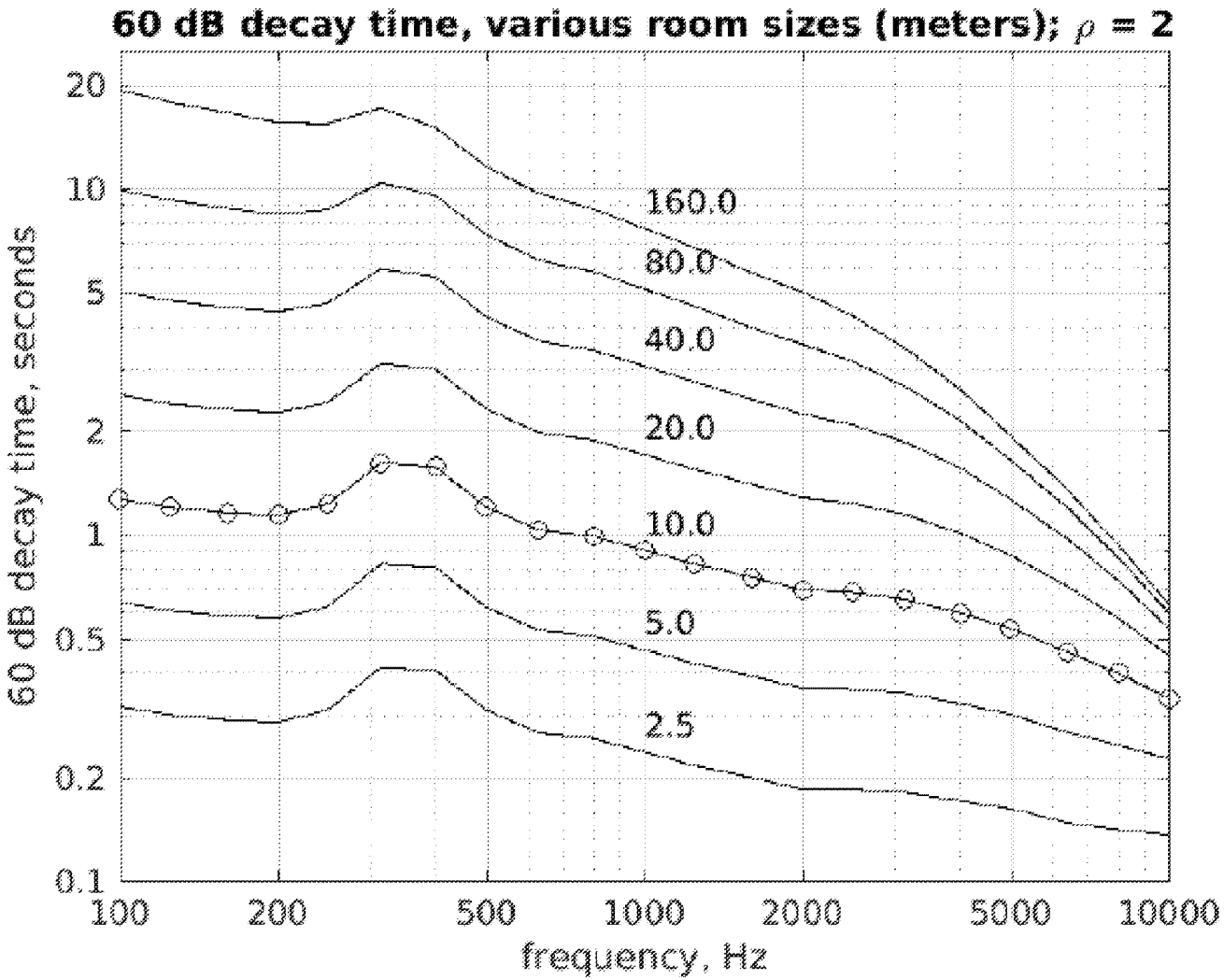
FIG. 7 is a waveform diagram illustrating an example reverberation time as a function of room size, with air absorption increased by a factor of two according to embodiments.
Figure 8:
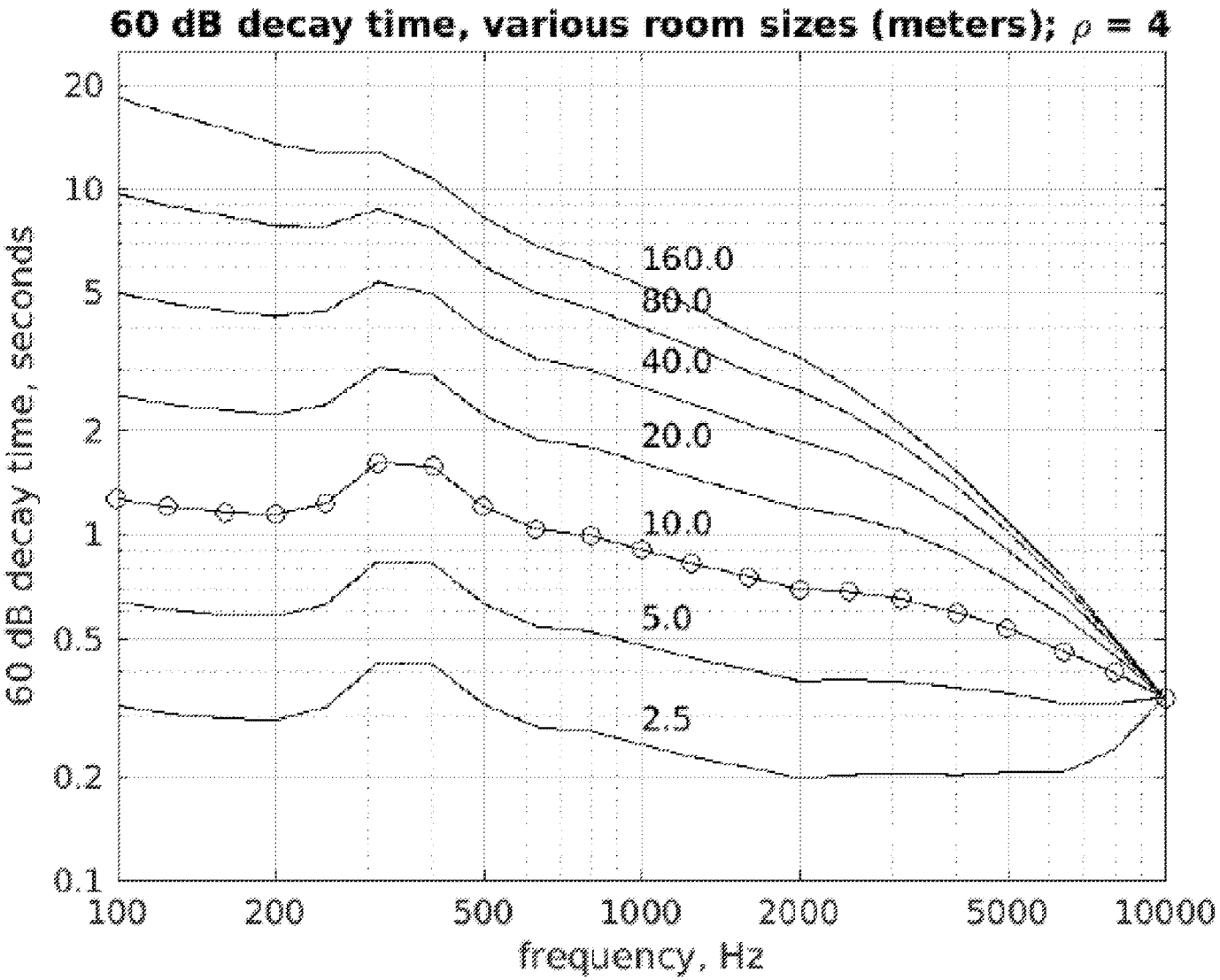
FIG. 8 is a waveform diagram illustrating an example reverberation time as a function of room size, with air ab-sorption increased by a factor of four according to embodiments.

As an example of a changing room size reverberation time with a modified air absorption, FIG. 7 and FIG. 8 show the reverberation times of FIG. 6 with the air absorption divided by p=2 and 4, respectively. Note that at the high frequencies at which the modified air absorption accounts for a substantial fraction of the absorption, changing room size has relatively little effect on reverberation time.

Convolutional Implementation

In the case of a convolutional reverberator [3, 4], the given or nominal room impulse response, $h_0(t)$, associated with a nominal room size $L_0$, may be resampled according to the new room size L to produce an adjusted impulse response $h_L(t)$, $$h_L(t)=h_0(t\cdot L_0/L). \quad (11)$$

Figure 9:
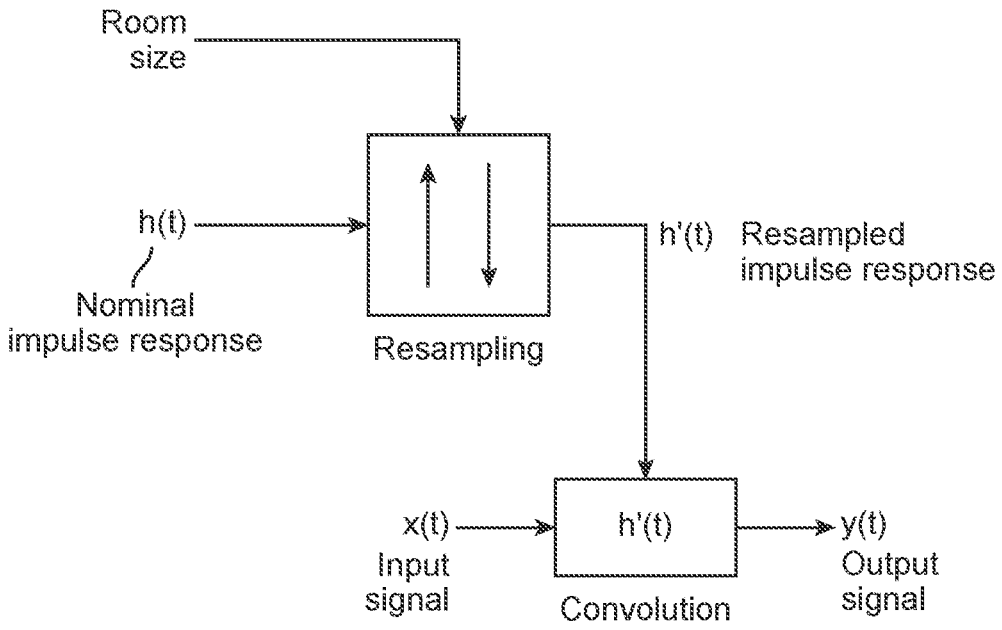
FIG. 9 is a functional block diagram illustrating an example convolutional reverberator operating on the impulse response so that it is time-stretched according to a room size control in embodiments.

As seen in FIG. 9, this adjusted impulse response may then be used to process an input signal x(t) to produce a reverberated output y(t) associated with the room of size L.

In the case that the room size L is smaller than the nominal room size $L_0$, the resampling will shorten the impulse response, thereby increasing its bandwidth. Accordingly, the resampling preferably would include the step of low-pass filtering so as to avoid aliasing if the increased bandwidth exceeds the Nyquist limit.

If L is larger than $L_0$, then the resampled (i.e., interpolated) impulse response will be longer than the nominal impulse response, and have decreased bandwidth. In this case, the adjusted impulse response may be extended to the Nyquist limit by first estimating reverberation characteristics such as decay times, equalization, echo density, and the like for that band. For instance, the decay times may be assumed to decrease in a manner typical of air absorption with increasing frequency above the original bandwidth. Additionally (or alternatively), a trend or model could be fit to the decay characteristic of the nominal impulse response, and extended in frequency. Similarly, the equalization could be extrapolated to higher frequencies by noting the trend near the nominal band edge.

The method described in [9] can be used to simulate an extended bandwidth for a room impulse response. Estimates of the echo density of the nominal impulse response are made, and used to synthesize a corresponding sequence of full-bandwidth echoes. This echo sequence (e.g., white Gaussian noise in the case of a perceived fully dense echo sequence) can then be split into frequency bands and windowed to generate a full-bandwidth room impulse response which sounds like the original. In this case, the high-frequency equalization and decay rates need to be synthesized, for example as described above.

In addition to extending the impulse response bandwidth, it is often the case that the impulse response is measured in the presence of a noise floor. As a result many available reverberation impulse responses have an envelope comprising the exponential decay of the late-field reverberation followed by a constant-level background noise.

The prior art mechanism of increasing the reverberation time by multiplying the reverberation impulse response by a growing exponential will generate unwanted artifacts, including a bloom in energy at the end of the impulse response [10, 11]. Resampling the impulse response as described above generally avoids this difficulty, though extending the impulse response to below the noise floor would benefit the present embodiments. It should be noted that such a mechanism for lengthening reverberation time, even when applied to a properly extended room response, is not preferred, as the timing of temporal features, such as significant early reflections, is not appropriately modified.

Figure 10:
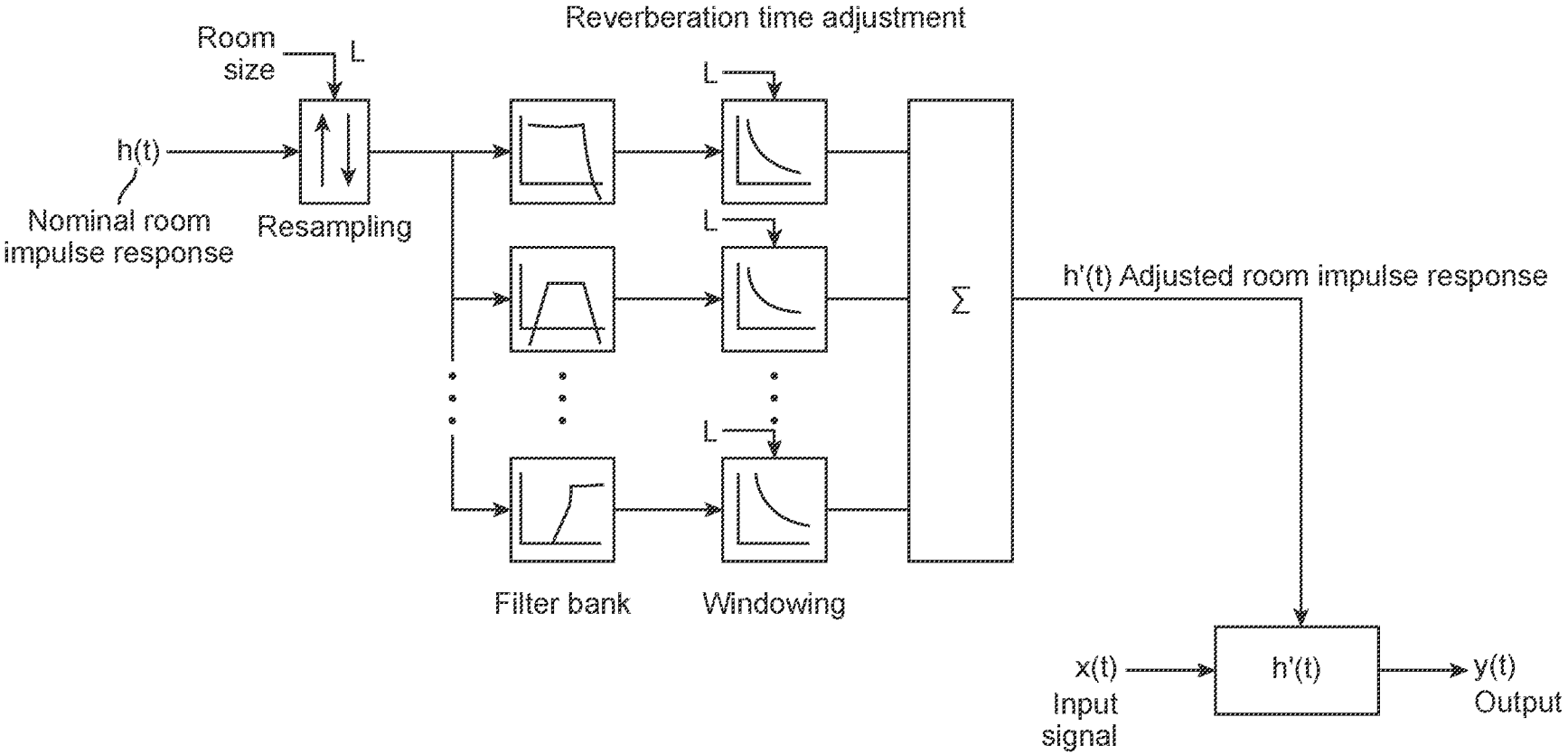
FIG. 10 illustrates an example convolutional reverberator process operating on the impulse response so that it is time-stretched and its reverberation times further adjusted according to a room size control according to embodiments.
Figure 11:
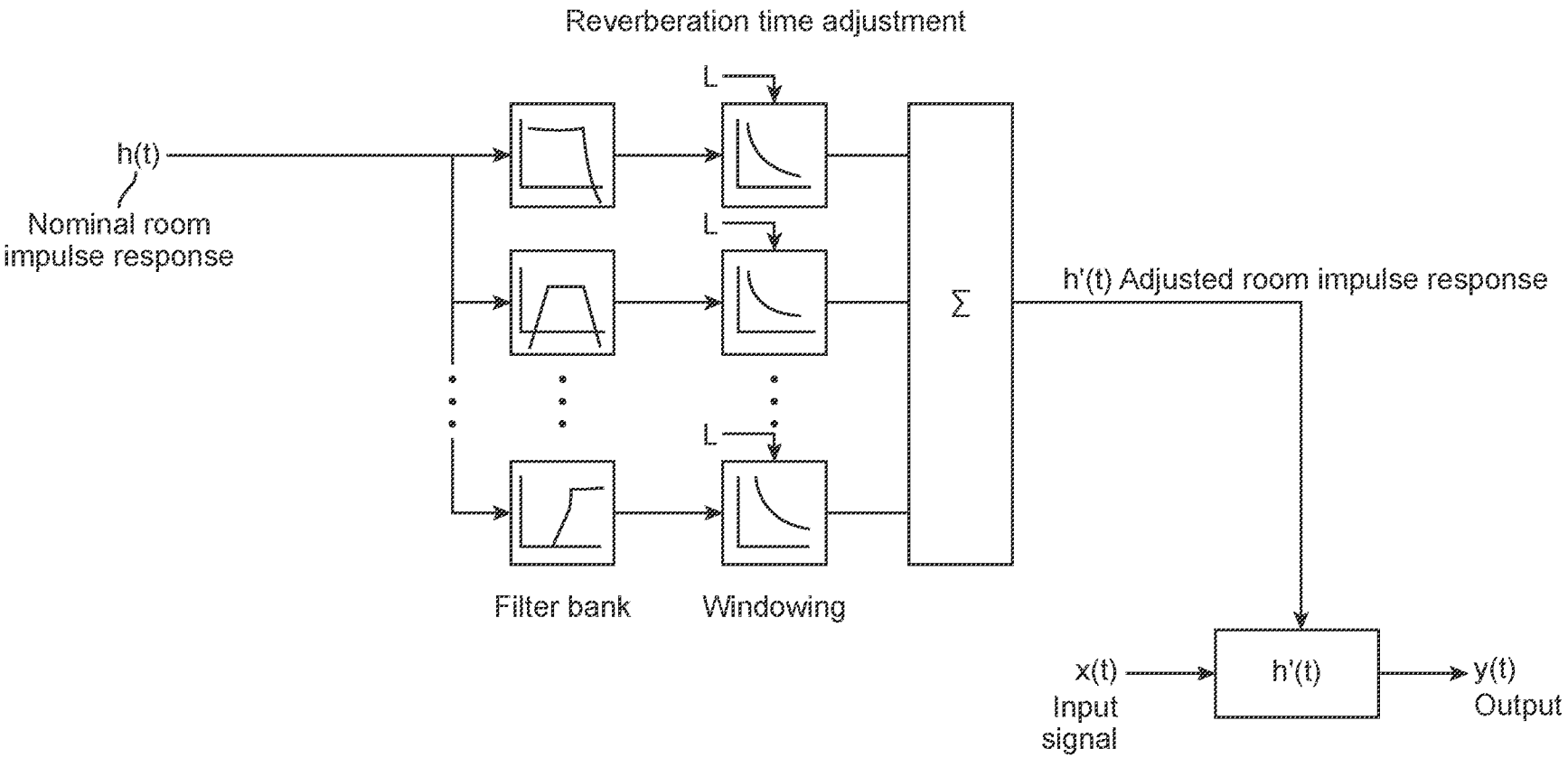
FIG. 11 illustrates an example convolutional reverberator in which the reverberation time in a set of frequency bands is adjusted according to room size according to embodiments.

As described above, the reverberation time of a larger or smaller room is roughly scaled by the relative change in size, and is affected by the different relative absorptions of air and materials, with materials absorption accounting for a greater portion of the decay in smaller rooms. The resampling of the impulse response described above has the effect of simultaneously stretching the reverberation time and compressing the associated frequency axis, $$\hat{T}_{60}(L, \omega) = \frac{L}{L_0} T_0(\omega \cdot L/L_0), \quad (12)$$

where $\hat{T}_{60}$ (L, ω) is the frequency-dependent reverberation time of the stretched impulse response $h_L(t)$, and $T_0(\omega)$ is that of the given impulse response h(t). For example, if a room impulse response were stretched by a factor of two, the reverberation time at 500 Hz would be twice that of the original impulse response at 1000 Hz. As a result, when the given reverberation time $T_0$ (ω) isn't relatively constant with frequency, the reverberation time produced by resampling h(t) will differ from the desired one given by (9), and it is preferred to modify the reverberation time of the stretched impulse response accordingly, see FIG. 10. As shown in FIG. 11, this may be accomplished by splitting the resampled room impulse response $h_L$ (t) into a set of frequency bands (for instance, half-octave-wide bands or ERB bands). Each band is then windowed—for example, with a growing or shrinking exponential function—to give it the desired reverberation time, and then the windowed bands are summed to form a room response having the appropriate amplitude envelope as a function of frequency. This process could also be applied to the given impulse response h(t) before resampling, with the band windowing anticipating the reverberation time changes produced by the resampling.

It should be pointed out that while Spratt and Abel [1] describe resampling the room impulse response as similar to changing the sound speed or resizing the room, this is only true if everything about the room is resized, including materials absorption features. In the present embodiments it is desired to scale the room size, without modifying the materials or air properties. It is thus preferred to correct the reverberation time produced by resampling as described above.

Figure 12:
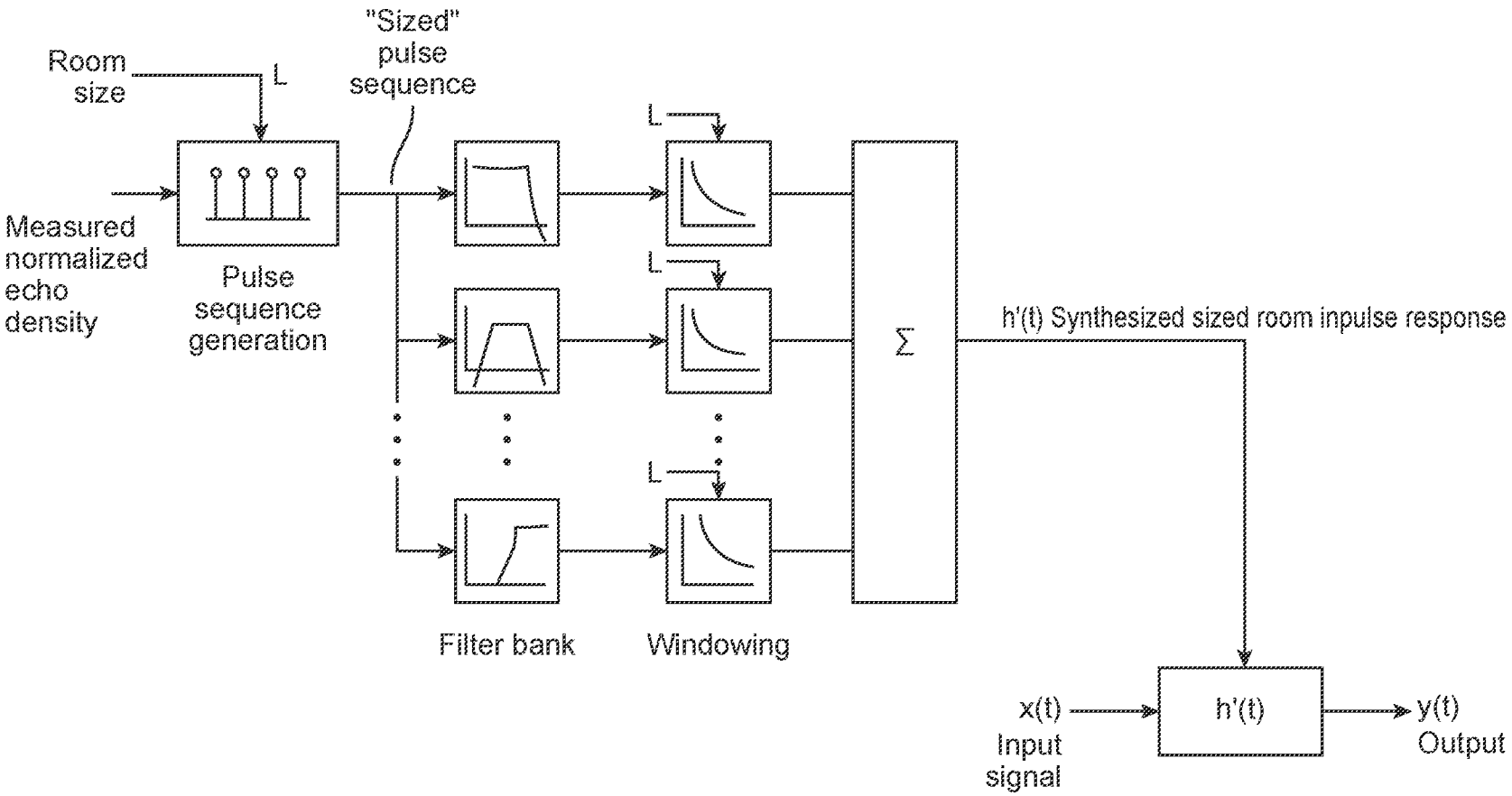
FIG. 12 illustrates an example convolutional reverberator in which a pulse sequence is synthesized, split into frequency bands, and the bands windowed and summed to form an impulse response used in a convolutional reverberator according to embodiments. The timing of the pulses and duration of the band envelopes are adjusted according to room size.

Finally, Applicant notes that the method described in [9] to synthesize impulse responses from balloon pop recordings may be adapted to synthesize room impulse responses at different room sizes. The process is shown in FIG. 12. Echo density is measured along the given impulse response h(t), and the impulse response root energy over time (e.g., an amplitude envelope) in a set of frequency bands is estimated. A statistically independent, but perceptually identical, nominal impulse response η(t) is then synthesized by randomly generating a set of full-bandwidth pulses according to the measured echo density. (Note that in cases where the reverberation becomes quickly dense, white Gaussian noise may be used in place of the statistical pulse sequence.) This pulse sequence is then split into a set of frequency bands, and the estimated amplitude envelope imprinted on the pulse sequence band, for instance, by multiplying the band signal by the given impulse response band root energy while dividing by the band signal root energy. The band signals are summed to form the nominal impulse response $\eta(t)$.

To generate impulse responses at different room sizes, the same process is used, with the pulse times being scaled by the room size or with the echo density used to generate the pulse times being scaled by the inverse room size. This pulse sequence is processed as above, but with the band root energy envelopes resampled according to the room size ratio $L/L_0$, and preferably the envelopes modified to bring the band reverberation times in line with the desired $T_{60}(L, \omega)$ described by (9) or (8) and (6).

Delay Network Implementation

Figure 1:
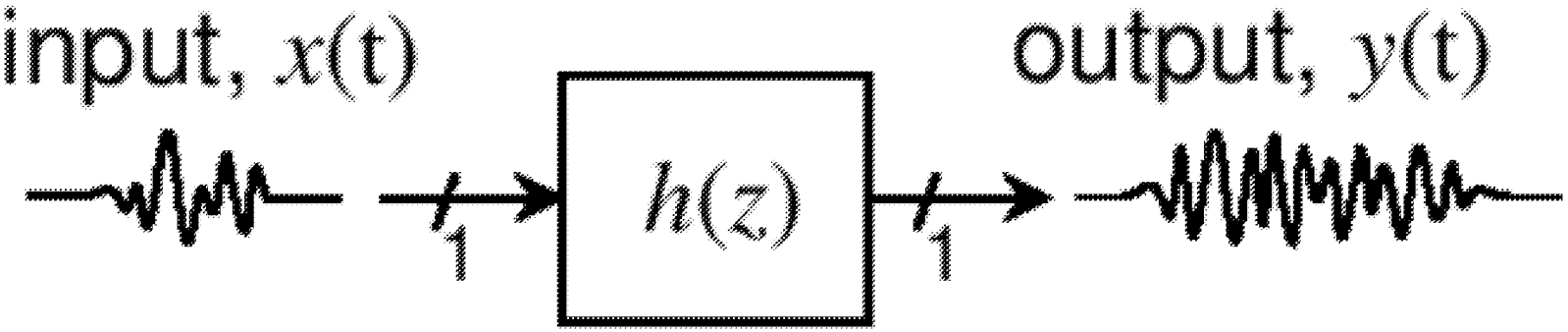
FIG. 1 illustrates a convolutional reverberator showing an input signal, x(t), convolved with a room impulse response h(t) to produce a reverberated output y(t).
Figure 2:
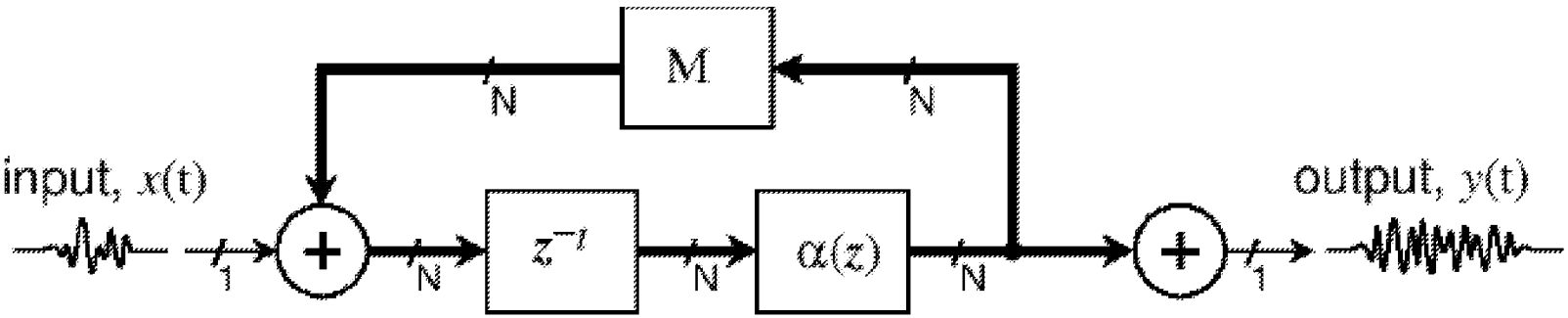
FIG. 2 illustrates an example feedback delay network reverberator, including a set of N delay lines $z^{-tn}$ and filters $g_n(z)$, n=1, 2, . . . , N, and an orthonormal mixing matrix Q.
Figure 3:
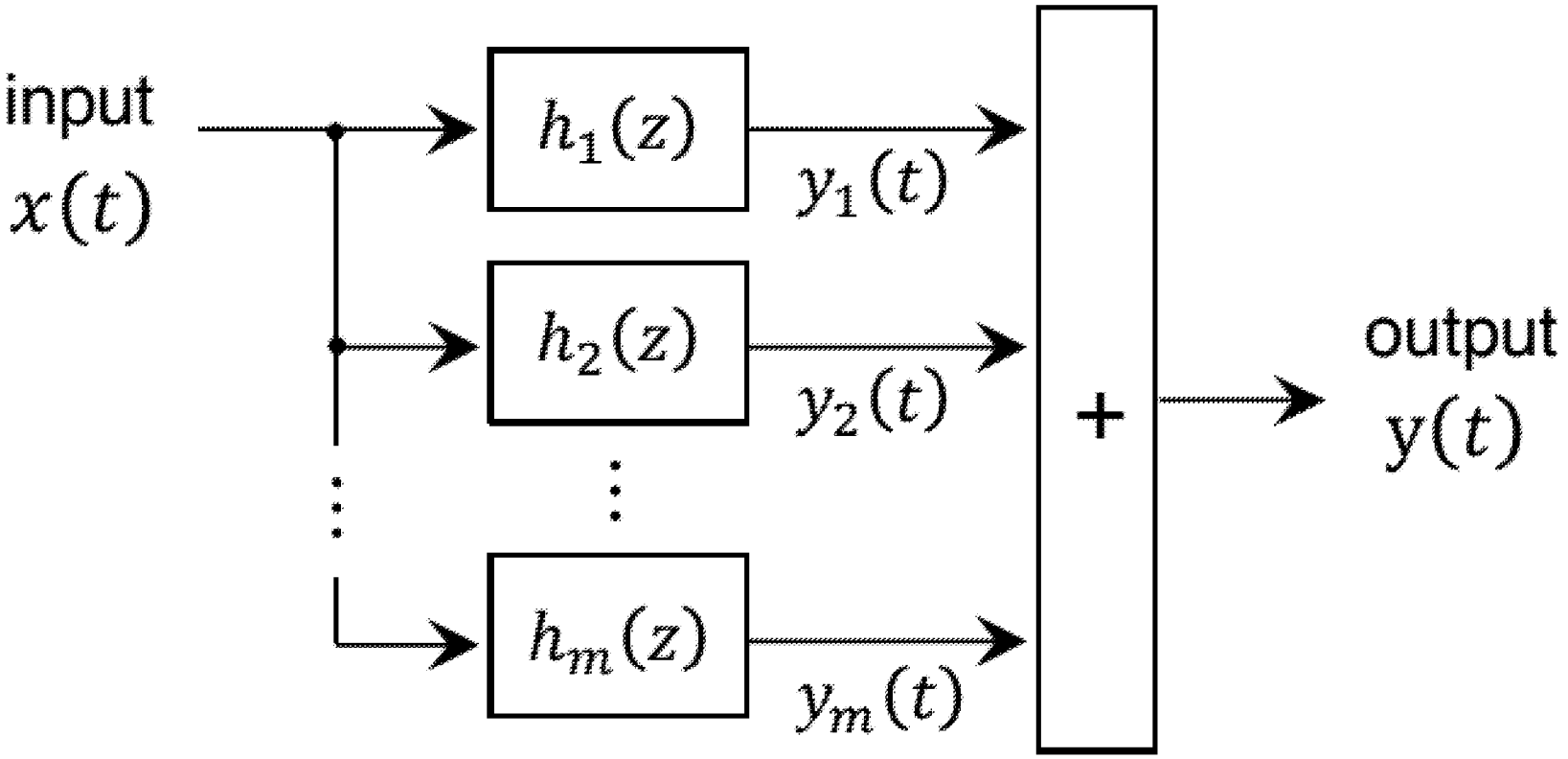
FIG. 3 illustrates an example modal reverberator having a parallel set of mode filters, each characterized by a mode frequency $\omega_m$, mode decay time $-\tau_m$, and mode amplitude $\gamma_m$.

As described in [2], reverberators are often implemented as networks of delay lines with filtering, mixing, and feedback. One such reverberator structure is the feedback delay network (FDN) [5], shown in FIG. 2. The FDN reverberator employs a tapped delay line to generate the direct path and early reflections. A set of delay lines with output filtering and feedback through a unitary mixing matrix is used to produce the late-field reverberation.

Here, the filter q(z) is the late-field equalization, with the N delay lines $z^{-\tau_n}$, n=1, 2, . . . , N having delays $\tau n$ and feedback filtering $g_n$ (z). The feedback filters are typically designed so that they produce similar dB attenuation per unit delay time according to a desired decay time as a function of frequency [5]. The unitary matrix Q represents state mixing, and controls the rate of echo density increase. An identity mixing matrix Q=I feeds each delay line to itself with no mixing between delay lines, and produces a constant echo density. A Hadamard mixing matrix Q=H generates significant mixing between delay lines, producing a rapidly increasing echo density.

Figure 13:
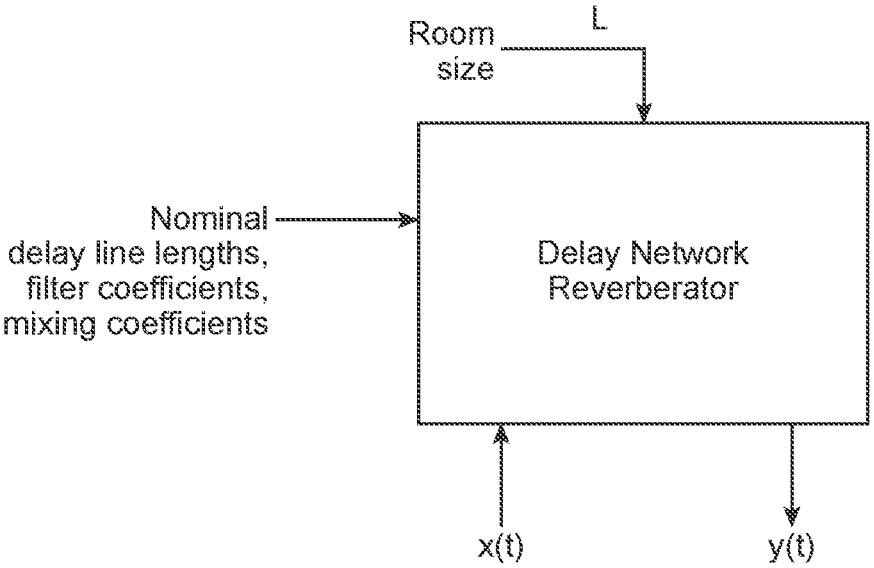
FIG. 13 illustrates an example delay network reverberator in which delay lengths, feedback and equalization filters, and mixing matrices are adjusted according to a room size control according to embodiments.
Figure 14:
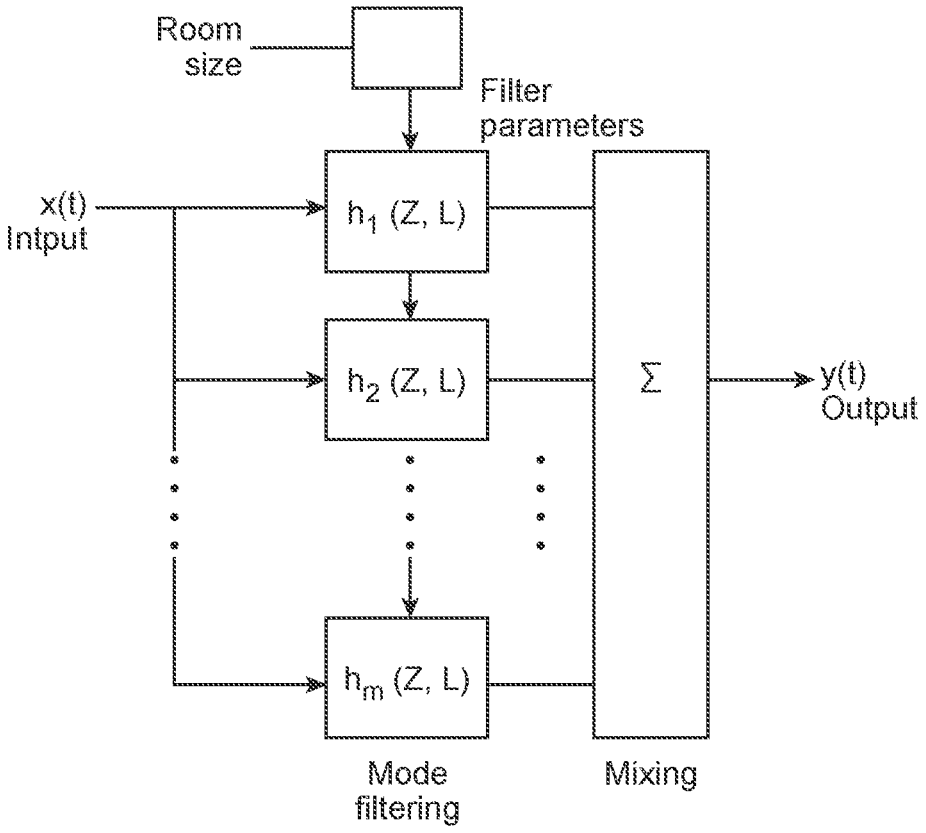
FIG. 14 illustrates an example modal reverberator having mode frequencies, decay times, and amplitudes modified according to a room size control according to embodiments.

To change the room size to L from a nominal $L_0$, the delay line lengths can be changed proportionately, as seen in FIG. 13, $$\tau_n(L) = \frac{L}{L_0}\tau_n(L_0),\ n = 1, 2, \ldots N. \tag{13}$$

Interpolated delay lines can be used to implement the desired early reflection delay times, but allpass filters are suggested to implement any fractional portion of delays used in the feedback loop so as to prevent unwanted magnitude filtering that would affect the resulting decay time.

The feedback filters $g_n(z)$ need not be modified, as the increased (or decreased) delay line lengths will result in proportionally longer (or shorter) decay times, the filters, in effect, being applied less (more) often. However, if desired, the feedback filters $g_n(z)$ can be modified so as to properly account for the effect of air absorption on the decay time. Additionally, note that by changing the feedback delay line lengths $\tau n$, the mixing matrix Q need not be modified in response to a changing room size, as the room mixing time will simply scale with the delay line lengths.

It might be the case that it is desired to leave the feedback delay lines fixed, independent of room size. In such scenarios, the preferred changes in reverberation time and echo density profile (e.g., mixing time) resulting from room size changes can be achieved by (i) adjusting the feedback filters $g_n(z)$, for example using [5], and (ii) modifying the mixing matrix Q so as to slow the state mixing for larger rooms, and speed state mixing for smaller rooms.

Finally, it should be pointed out that if the delay line lengths are to be smoothly changed from one set of delay values to another, they may be smoothly interpolated between successive delay values or they may be crossfaded between successive delay values. Crossfading will eliminate Doppler shifts associated with a continuously changing delay, which might be desirable for music applications, but can introduce subtle artifacts during the crossfade period.

Modal Implementation

As presented in [6, 7], the modal reverberator implements reverberation as a parallel sum of resonant filters $h_m(t)$, each representing a room resonance or mode, and each characterized by a mode frequency $\omega_m$, mode decay rate $\sigma_m$, and mode amplitude $\gamma_m$, $$h(t) = \sum_{m=1}^{M} h_m(t), \tag{14}$$

where, for example, $$h_m(t) = \gamma_m \exp\{j\omega_m t - \sigma_m t\}. \tag{15}$$

A number of options are described for implementing such filters in [6, 7], including biquad structures, phasor filters, and heterodyning-modulation architectures.

To implement a changing room size in a modal reverberator, the mode parameters are adjusted accordingly. The mode frequencies would be changed in inverse proportion to the varying room size, $$\omega_m(L) = \frac{L_0}{L}\omega_m(L_0),\ m = 1, 2, \ldots M. \tag{16}$$

One way to understand this is to consider a closed path among a set of reflecting surfaces that creates a resonance. If the path length were twice as long, the associated travel time would be twice as long, and the frequency reduced to half its original value.

The mode decay rates would be modified according to the scaled decay times at the new mode frequencies as described above in (6), $$T_{60}(L, \omega_m(L)) = \frac{L}{L_0\mu(\omega_m(L)) + L\alpha(\omega_m(L))}, \tag{17}$$

where the decay times $T_{60}(L, \omega_m(L))$ can be found by interpolation if they are not directly available. The decay rates $\sigma_m(L)$ at room size L are then $$\sigma_m(L) = \frac{\ln 1000}{T_{60}(L, \omega_m(L))}. \tag{18}$$

If the room size L is made smaller than the nominal room size $L_0$, then the mode frequencies will be increased. Those modes with frequencies that become larger than the Nyquist limit can be eliminated, for instance, not computed or their amplitudes reduced to zero.

If the room size L is made larger than the nominal room size $L_0$, then the mode frequencies will be decreased. Those modes with frequencies that become smaller than the audio band lower limit, or the lower limit of what can be reproduced with the target sound reproduction system, can be eliminated. As in the case of manipulating an impulse response in response to room size changes described above, an increase in room size may significantly reduce the bandwidth of the modal reverberator response, and additional bandwidth would be preferably created. This may be done by synthesizing additional high-frequency modes, for example statistically generating 240 additional mode frequencies per octave with decay rates extrapolated from those at lower frequencies. (Similarly, lower-frequency modes may be synthesized in the case of rooms that are smaller than the nominal size $L_0$.)

As an alternative to eliminating and synthesizing modes to accommodate a changing room size, the mode frequencies $\omega_m$ can be warped within the audio band to generate new frequencies $v_m$, for example according to a first-order allpass characteristic, $$e^{-jv_m} = \frac{\rho + e^{-j\omega_m}}{1 + \rho e^{-j\omega_m}}, \text{ that is,} \tag{19}$$

$$v_m = j\ln\left\{\frac{\rho + e^{-j\omega_m}}{1 + \rho e^{-j\omega_m}}\right\}. \tag{20}$$

Here, the allpass parameter ρ is chosen according to the room size ratio $L/L_0$, $$\rho = \frac{L - L_0}{L + L_0}. \tag{21}$$

Doing so will scale the low frequencies according to the desired linear characteristic $$v_m(L) \approx \frac{L_0}{L}\omega_m(L_0),\ |\omega_m| \ll 1, \tag{22}$$

with the high frequencies being warped to map the band edge ω onto the band edge v.

Note that if it is desired to retain the original reverberation equalization, the mode amplitudes can be adjusted with room size to account for the changing equalization resulting from a changing modal density: Where the modal density is increased, the mode energy (the square of the mode magnitude) is proportionally increased.

The mode filter parameters may be changed continuously, though to eliminate the associated Doppler shifts, it is suggested that mode filters at successive parameter sets be run in parallel and crossfaded. It could also be useful to modify the mode decay times without changing the mode frequencies.

Finally, the circumstance in which only aspects of the room were made larger or smaller—for example only a pair of walls being moved further apart—can be accommodated by having certain modes be unaffected or only modestly affected. Similarly, in the delay network reverberator structures above, only certain delay lines could be affected or others only modestly affected by a changing room size.

Although the present embodiments have been particularly described with reference to preferred ones thereof, it should be readily apparent to those of ordinary skill in the art that changes and modifications in the form and details may be made without departing from the spirit and scope of the present disclosure. It is intended that the appended claims encompass such changes and modifications.

The following publications have been identified by the corresponding reference numerals in brackets [ ] in the above descriptions, and the details below are incorporated into the descriptions above:

[1] Kyle S. Spratt, Jonathan S. Abel, "All natural room enhancement," in Proc. of the International Computer Music Conference (ICMC 2009), Montreal, Canada, Aug. 16-21, 2009.

[2] Vesa Valimaki, et al., "Fifty years of artificial reverberation," IEEE Trans. Audio, Speech, and Lang. Proc., Vol. 20, No. 5, July 2012.

[3] William Gardner, "Efficient convolution without input-output delay," Journal of the Audio Engineering Society, Vol. 43, Issue 3, pp. 127-136, March 1995.

[4] Guillermo Garcia, "Optimal filter partition for efficient convolution with short in-put/output delay," in Proc. 113th Convention of the Audio Engineering Society, Paper No. 5660, Los Angeles, October 2002.

[5] feedback delay network reverberator

[6] Jonathan S. Abel, Sean A. Coffin, Kyle S. Spratt, "A Modal Architecture for Artificial Reverberation with Application to Room Acoustics Modeling," in Proc. 137th Convention of the Audio Engineering Society, Los Angeles, October 2014.

[7] Jonathan S. Abel, "Method and system for artificial reverberation using modal decomposition," U.S. Pat. No. 9,805,704, Oct. 31, 2017.

[8] Friedrich Spandock, "Method and Apparatus for Determining Acoustic Effects," U.S. Pat. No. 3,139, 151, June 1964.

[9] Jonathan S. Abel, et al., "Estimating room impulse responses from recorded balloon pops," in Proc. 129th Convention of the Audio Engineering Society, Paper No. 8171, San Francisco, November 2010.

[10] Nicholas J. Bryan, Jonathan S. Abel, "Methods for Extending Room Impulse Responses Beyond Their Noise Floor," in Proc. 129th Convention of the Audio Engineering Society, Paper No. 8167, San Francisco, November 2010.

[11] Elliot Kermit Canfield-Dafilou and Jonathan S. Abel, "On restoring prematurely truncated sine sweep room impulse response measurements," in Proceedings of the 20th International Conference on Digital Audio Effects (DAFx-17), Edinburgh, UK, Sep. 5-9, 2017.

[12] James A. Moorer, "About This Reverberation Business," Computer Music Journal, Vol. 3, No. 2, pp. 13-28, June 1979.

[13] Jeffrey Borish, "Extension of the image model to arbitrary polyhedra," J. Acoust. Soc. Am., vol. 75, no. 6, pp. 1827-1836, June 1984.

[14] Wallace C. Sabine, "Theatre Acoustics," in Collected Papers on Acoustics, Dover Publications Inc., New York, 1964.

[15] American National Standards Institute, Committee 51, Acoustics, Method for Calculation of the Absorption of Sound by the Atmosphere, ANSI 51.26-1995, New York, N.Y.: American National Standards Institute, September, (1995).

[16] International Organization for Standardization, Committee ISO/TC 43, Acoustics, Sub-Committee SC 1, Noise, Acoustics Attenuation of sound during propagation outdoors-Part 1: Calculation of the absorption of sound by the atmosphere, ISO9613-1, Geneva, Switzerland: International Organization for Standardization, (1993).

What is claimed is:

1. An artificial reverberator comprising:

an input for accepting a nominal room impulse response;

an input for accepting a perceived room size control, wherein the perceived room size control specifies a perceived room size that is different than a nominal room size associated with the nominal room impulse response; and a convolution operation with a processing room impulse response, wherein the processing room impulse response is derived by resampling a generating room impulse response related to the nominal impulse response according to the perceived room size control.

2. The artificial reverberator of claim 1, wherein the generating room impulse response is the nominal room impulse response, augmented to have high-frequency or low-frequency content that may appear in the audio band under the resampling.

3. The artificial reverberator of claim 1, in which the generating room impulse has decay times that are manipulated versions of nominal impulse response decay times, wherein the manipulation is affected by the room size control.

4. The artificial reverberator of claim 1, wherein the processing room impulse has decay times that are adjusted according to the room size control.

5. A method for artificial reverberation comprising:

identifying a nominal room impulse response;

identifying a perceived room size control, wherein the perceived room size control specifies a perceived room size that is different than a nominal room size associated with the nominal room impulse response;

forming a processing room impulse response by adjusting the nominal room impulse response according to the perceived room size control; and convolving a signal with the processing room impulse response.

6. The method for artificial reverberation of claim 5 further comprising resampling in forming the processing room impulse response.

7. The method for artificial reverberation of claim 5 further comprising adjusting reverberation time in a band of frequencies according to the perceived room size control in forming the processing room impulse response.

8. A method for adjusting a perceived room size of an artificial reverberator comprising:

identifying a nominal reverberation decay time;

identifying a perceived room size control, wherein the perceived room size control specifies the perceived room size that is different than a nominal room size associated with the nominal room reverberation decay time;

identifying a decay time associated with air absorption; and forming a desired reverberation time by adjusting the nominal reverberation decay time according to the perceived room size control and taking into account the air absorption decay time.

9. The method of claim 8 further comprising:

forming implicitly or directly an estimate of the nominal reverberation decay time not attributable to air absorption.

10. A system for artificial reverberation comprising a perceived room size control, wherein the perceived room size control specifies a perceived room size that is different than a nominal room size, and a network of delay lines, each having a nominal length associated with the nominal room size, and wherein the length of at least one of the delay lines is adjusted from the nominal length according to the perceived room size control.

11. The system for artificial reverberation according to claim 10 further comprising means to accept a nominal reverberation time; and a feedback filter associated with at least one of the delay lines, wherein the feedback filter is adjusted according to the perceived room size control to substantially achieve a reverberation time determined by the perceived room size control and the nominal reverberation time.

12. The system of claim 11 further comprising:

feedback paths associated with outputs of at least two of the delay lines comprising the network and inputs of the at least two delay lines, wherein an amount of feedback from one of the at least two delay lines to another one of the at least two delay lines is adjusted according to the room size control.

13. A system for artificial reverberation comprising:

a perceived room size control, wherein the perceived room size control specifies a perceived room size that is different than a nominal room size associated with a nominal room impulse response, a set of resonant filters representing modes of a room, the set of resonant filters being derived from the nominal room impulse response, each resonant filter characterized by a mode frequency and mode decay rate, and a means to adjust the mode decay rate associated with one of the resonant filters in response to the perceived room size control.

14. The system of claim 13 further comprising:

a means to adjust the mode frequency associated with one of the resonant filters in response to the perceived room size control.

* * * * *